US005784983A

United States Patent [19]

Stegall

[11] Patent Number: 5,784,983

[45] Date of Patent: Jul. 28, 1998

[54] BACK SUPPORT APPARATUS FOR OUTBOARD BOAT

[75] Inventor: Barry Desmond Stegall, Broken Arrow, Okla.

[73] Assignee: Brunswick Corporation, Lake Forest, Ill.

[21] Appl. No.: 665,789

[22] Filed: Jun. 18, 1996

[51] Int. Cl.[6] ..... B63B 17/00

[52] U.S. Cl. ..... 114/363

[58] Field of Search ..... 114/363, 343; 297/352, 353

[56] References Cited

U.S. PATENT DOCUMENTS

| | | | |
|---|---|---|---|
| 1,005,542 | 10/1911 | Harmer . | |
| 3,642,320 | 2/1972 | Ward . | |
| 4,425,863 | 1/1984 | Cutler | 114/363 |
| 4,428,617 | 1/1984 | Lawson . | |
| 4,803,945 | 2/1989 | Adams et al. . | |
| 4,928,620 | 5/1990 | Currey | 114/363 |
| 5,449,305 | 9/1995 | Kobayashi et al. | 114/363 |

*Primary Examiner*—Stephen Avila
*Attorney, Agent, or Firm*—Rosenblatt & Redano P.C.

[57] ABSTRACT

A height-adjustable standing back support for a fisherman in a boat is disclosed. The support can be generally a U-shape and can be arcuate or can comprise adjacent straight segments for an overall U-shape. The support is cushioned and has storage compartments for various accessories and other items typically used by a fisherman. The support is height adjustable and is secured to a base on the deck of the boat so that it cannot rotate the support about a vertical axis. The cushion gives steady support to a standing fisherman while fishing or controlling the boat.

20 Claims, 3 Drawing Sheets

BACK SUPPORT APPARATUS FOR OUTBOARD BOAT

FIELD OF THE INVENTION

The field of this invention relates to a back support apparatus.

BACKGROUND OF THE INVENTION

In the past, seats and pedestal-mounted back supports for fishermen have been provided on boats mounted to a post which swivel above a vertical axis. Fishermen found the swivel seats to be comfortable, making it easier to face any portion of the boat as needed.

However, depending on the function being performed, the need for stability changes. While sitting down and controlling the boat, a swivel seat with back support has been provided to make it easy for the fisherman to pivot and generally keep a proper lookout in the direction of movement of the boat. Additionally, a swivel-type seat was useful for brief rearward looks to talk to passengers in the stern of the boat or to keep an eye on water skiers being pulled behind the boat. Typical of such devices were U.S. Pat. Nos. 3,642,320 and 4,428,617.

However, when standing up and casting, while the boat is stationery or moving with the aid of a trolling motor, a greater degree of stability was required.

The prior designs using back supports to catch the lower back of the fisherman were provided without any feature to prevent them from rotating in a horizontal plane about a vertical axis. One example is U.S. Pat. 4,803,945. As a result, when the fisherman moved as required to cast the lure into the water, the lack of stability of the swiveling back supports diminished their usefulness. Even worse, sudden twisting of the back support could catch the fisherman off guard and result in a fall, which could present a risk of personal injury.

Accordingly, it is an object of this invention to provide a back support for a standing fisherman to stabilize the fisherman during fishing or motoring when the fisherman is in a standing position. It is further an object of the present invention to allow adjustability to accommodate various fisherman of different heights, as well as flexibility to turn about 45 degrees left or right at a particular height. Finally, it is an object of the present invention to provide a convenient, comfortable, and stabilizing back support while at the same time providing containers and other storage areas to house items typically used by a fisherman on a boat.

SUMMARY OF THE INVENTION

A height-adjustable standing back support for a fisherman in a boat is disclosed. The support can be generally a U-shape and can be arcuate or can comprise adjacent straight segments for an overall U-shape. The support is cushioned and has storage compartments for various accessories and other items typically used by a fisherman. The support is height adjustable and is secured to a base on the deck of the boat so that it cannot rotate about a vertical axis. The cushion gives steady support to a standing fisherman while fishing or controlling the boat.

DETAILED DESCRIPTION OF THE PREFERRED EMBODIMENT

Figure 1:
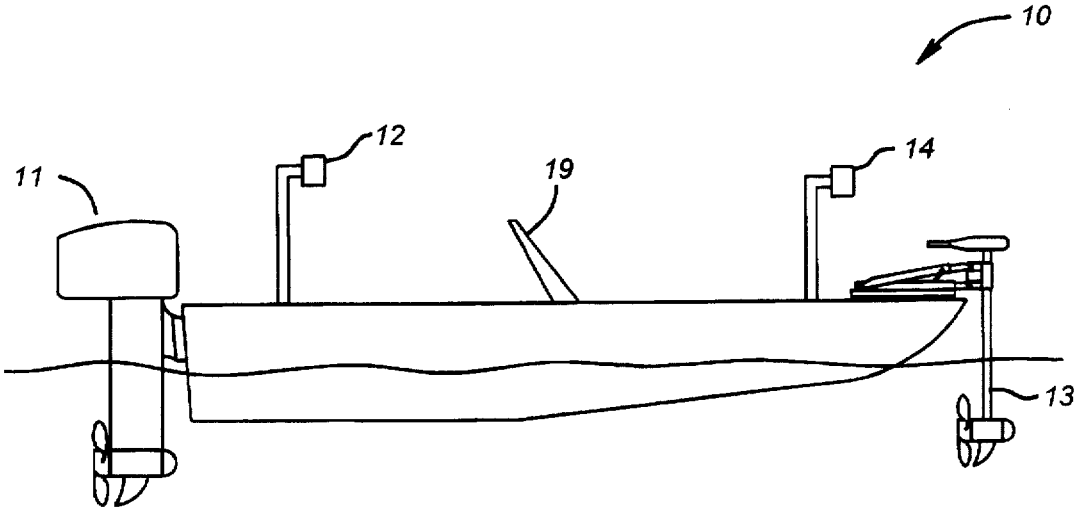
FIG. 1 is an elevational view of a boat showing the location of the standing supports.
Figure 2:
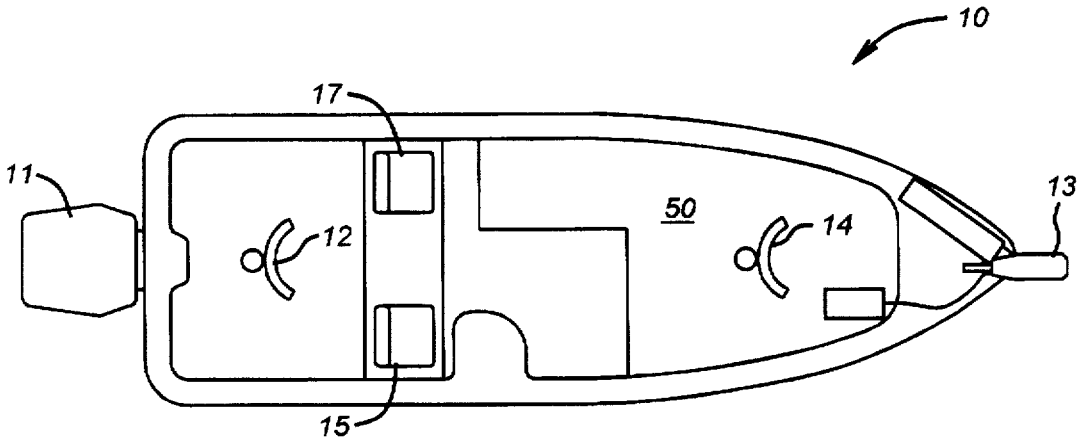
FIG. 2 is a plane view of FIG. 1, showing the location of the standing supports in the boat.
Figure 3:
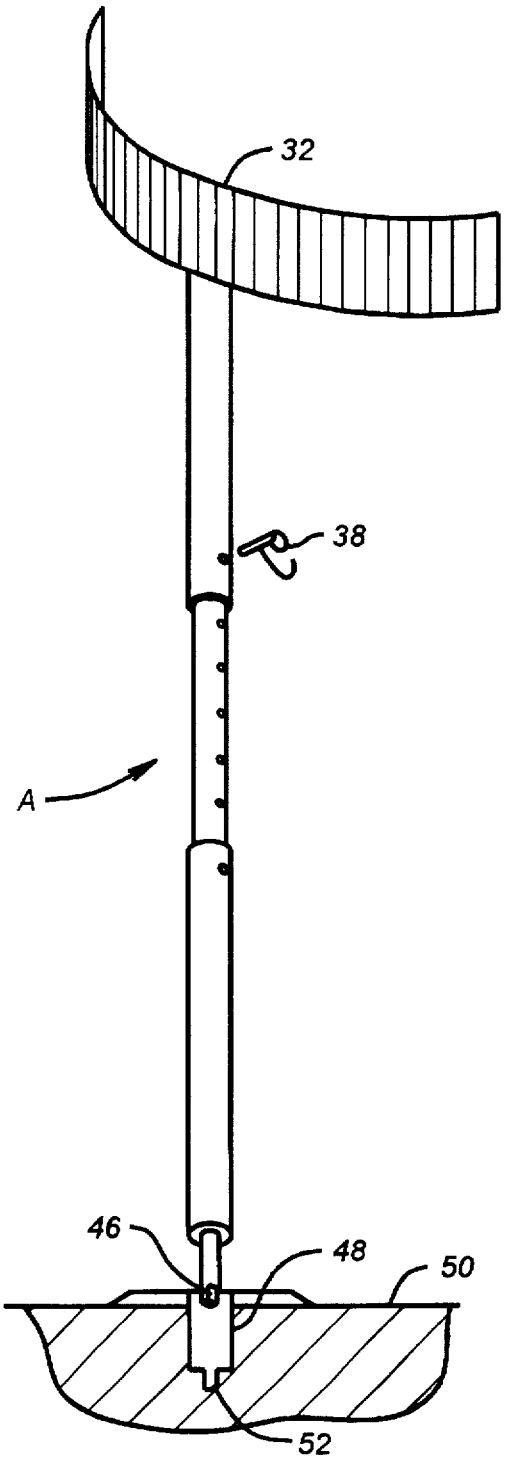
FIG. 3 is a perspective view illustrating the nonrotating stanchion and the base into which it fits in a nonrotational manner.

The apparatus A of the present invention is illustrated in FIG. 3. Generally, a boat 10 has a motor 11 which, in FIG. 1, is depicted as an outboard motor. Shown in the bow is a trolling motor 13 lowered into the water in position for trolling the boat 10. The boat 10 has seats 15 and 17 disposed behind a windshield 19. As shown in the plan view of FIG. 2, there is a stern standing support 12 and a bow standing support 14. Those skilled in the art will appreciate that the configuration of the components in the boat above described can be different and that the scope of this invention is addressed to the structure and configuration of a standing support such as 12 and 14.

Figure 6:
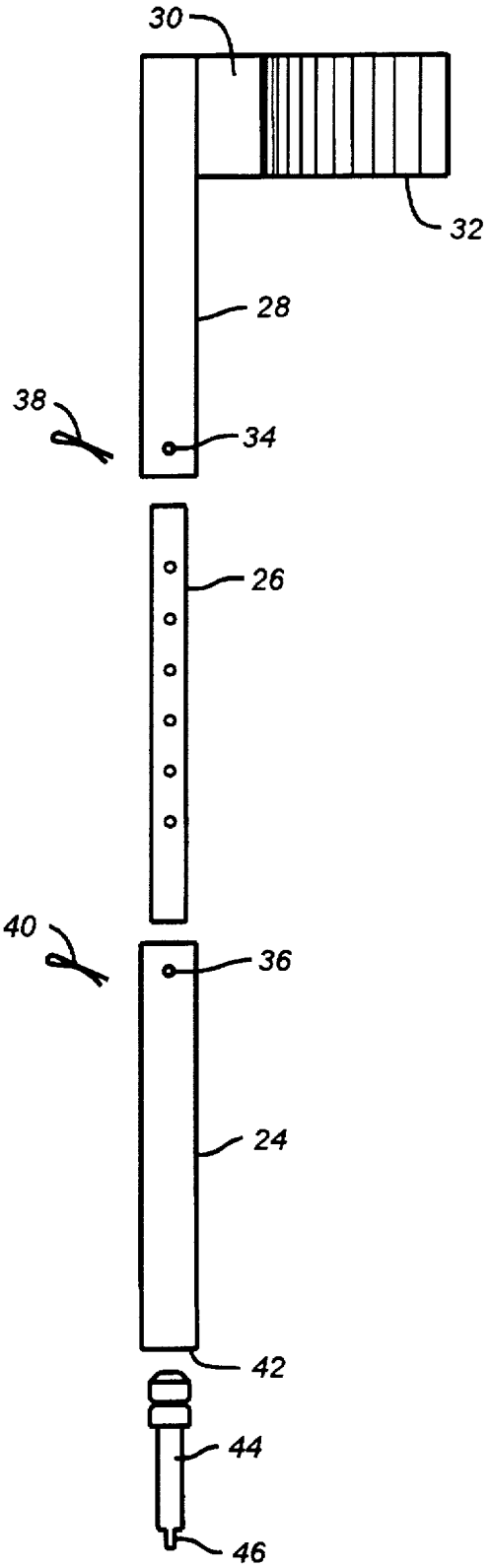
FIG. 6 is an exploded view of FIG. 3.

Referring now to FIGS. 3 and 6, which are equally applicable to either bow or stern supports 12 or 14, there is disclosed a stanchion assembly comprising a lower section 24, a middle section 26, and an upper section 28. Upper section 28 has a bracket 30 which extends toward the U-shaped cushion 32. As seen in FIG. 3, the U-shaped cushion 32 supports the lower back of the fisherman. The height of the stanchion assembly can be adjusted by moving lower or upper sections 24 or 28 with respect to middle section 26 while there are no pins extending into holes 34 or 36. Pins 38 and 40 are designed to be placed through holes 34 and 36, respectively, when aligned with any of the holes in middle section 26 for vertical adjustment of the U-shaped cushion 32. Holes in section 26 can be offset so that at a given elevation, the bracket 30 can be turned left or right about 45 degrees and that position locked in with pin 38.

Insertable into the lower end 42 of lower section 24 is a pin 44 which has a protruding tab 46 insertable into a base 48 secured to the deck 50 of the boat 10 (see FIG. 3). The base 48 has a depression 52 shaped to accept the tab 46 such that when the lower section 24 is inserted into the base 48, built into the boat or firmly supported and prevented from rotating about its longitudinal axis.

Figure 4:
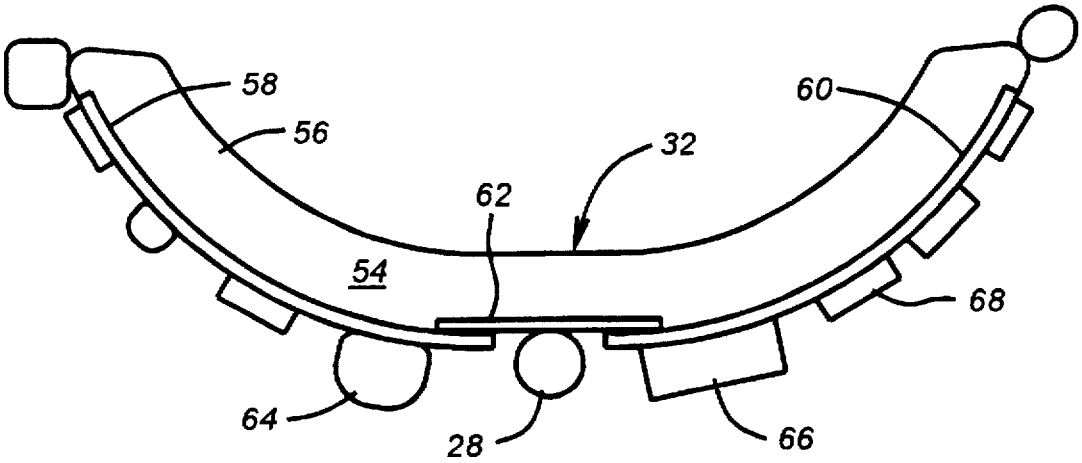
FIG. 4 is a plane view of the cushion of the standing support, showing the storage compartments behind and the mounting of the stanchion to the cushion.

FIG. 4 is a top view of the U-shaped cushion 32. The cushion 32 is generally padded with padding 54 and covered with an exterior material such as vinyl 56. Around the back end are panels 58 and 60. In one embodiment, the upper section 28 has a mounting plate 62, which is in turn affixed to both the upper section 28 and the panels 58 and 60. Also securable to the panels 58 and 60 are a plurality of pockets, straps and holders to store a variety of items on the back of the panels 58 and 60. These pockets and straps can hold various sundry items such as fish formula 64, a camera 66, pliers 68, and the like.

Figure 5:
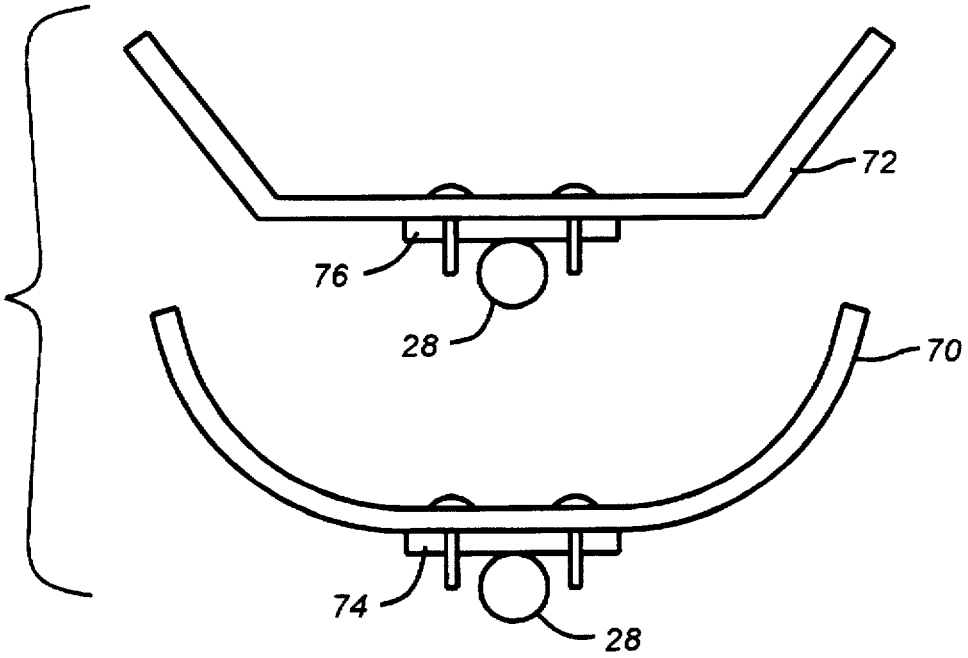
FIG. 5 is a detailed view of the attachment of the cushion to the stanchion.

FIG. 5 shows alternatives to the U-shaped cushion section 32 and the mounting system to the upper stanchion section 28. The padding 54 is removed for clarity showing an arcuate backing member 70 or a segmented flat backing member 72. In both instances, the cushion 21 is preferably U-shaped. In each case, bolts extend through the backing member 70 or 72 and connect to a mounting plate 74 or 76, which is securely attached to the upper section 28 of the stanchion assembly.

Those skilled in the art will appreciate that the height adjustments made possible by using the segmented stanchion can accommodate fisherman as short as 5 feet or less up to those over 6 foot 4. Using the combination of the tab 46 extending into the receptacle or slot 52, rotation of the stanchion assembly about its longitudinal axis is prevented; thus stabilizing the U-shaped cushion 32 when it is being used by the fisherman in a standing position for casting or controlling the boat 10. The apparatus of the present invention overcomes the shortcomings of the prior designs which allowed the stanchion to swivel; thus reducing the stabilizing effect of the assembly for the fisherman while standing and casting or controlling the boat.

It should be noted that the pin 44 can be made a separate component which slips in and secures internally to the lower section 24 or it can be made to be an integral structure with the lower section 24 without departing from the spirit of the invention. Other types of clamping and height adjustment mechanisms can be employed in lieu of the series of aligned holes shown in FIG. 6 for a height adjustment without departing from the spirit of the invention. Compression clamps are but one example. Various options of mounting the U-shaped support cushion 32 to the stanchion assembly can be employed without departing from the spirit of the invention.

The foregoing disclosure and description of the invention are illustrative and explanatory thereof, and various changes in the size, shape and materials, as well as in the details of the illustrated construction, may be made without departing from the spirit of the invention.

I claim:

1. A boat standing support for a person standing in a boat having a deck, comprising:

a pedestal having a longitudinal axis;

a support pad mounted to the pedestal for contact by the person standing in the boat; and a base secured to the deck area, the base supporting the pedestal and preventing rotation of the support pad about the longitudinal axis of the pedestal.

2. The apparatus of claim 1, further comprising:

a height-adjustment mechanism on the pedestal for repositioning said support pad with respect to the deck.

3. The apparatus of claim 1, wherein:

the base has a receptacle; and the pedestal has a tab at the lower end which fits into the receptacle to prevent rotation of the support pad about the longitudinal axis of the pedestal.

4. The apparatus of claim 1, wherein:

the support pad further comprises at least one pocket or retainer for articles on one side thereof for storage of articles.

5. The apparatus of claim 4, further comprising:

a plurality of pockets or retainers for articles on the support.

6. The apparatus of claim 1, wherein:

the support pad is generally U-shaped to accommodate the back of a fisherman.

7. The apparatus of claim 6, wherein:

the support pad is arcuate.

8. The apparatus of claim 6, wherein:

the support pad comprises a plurality of generally planar segments which together have a U-shape.

9. The apparatus of claim 2, wherein:

the pedestal further comprises;

a plurality of overlapping segments each having at least one opening therethrough;

a fastener insertable through different combinations of aligned openings to adjust the height of said support pad.

10. The apparatus of claim 2, wherein:

the base has a receptacle; and the pedestal has a tab at the lower end which fits into the receptacle to prevent rotation of the support pad about the longitudinal axis of the pedestal.

11. The apparatus of claim 10, wherein:

the support pad further comprises at least one pocket or retainer for articles on one side thereof for storage of articles.

12. The apparatus of claim 11, further comprising:

a plurality of pockets or retainers for articles on the support pad.

13. The apparatus of claim 12, wherein:

the support pad is generally U-shaped to accommodate the back of a fisherman.

14. The apparatus of claim 13, wherein:

the support pad is arcuate.

15. The apparatus of claim 13, wherein:

the support pad comprises a plurality of generally planar segments which together have a U-shape.

16. The apparatus of claim 13, wherein the pedestal further comprises:

a plurality of overlapping segments, each having at least one opening therethrough;

a fastener insertable through different combinations of aligned openings to adjust the height of the support pad.

17. The apparatus of claim 2, wherein the pedestal further comprises:

at least two components which can be selectively secured at a given height in a multiplicity of angular orientations with respect to the longitudinal axis.

18. The apparatus of claim 17, wherein:

the angular orientations span a range of about 90 degrees.

19. A standing support for a person standing in a boat having a deck, comprising:

a pedestal having a longitudinal axis;

a support pad mounted to the pedestal;

a base secured to the deck area, the base supporting the pedestal and preventing rotation thereof about its longitudinal axis;

the pedestal further comprises at least two components which can be selectively secured at a given height in a multiplicity of angular orientations with respect to the longitudinal axis;

one of the segments has a plurality of openings at a given elevation so as to allow different angular orientations of the support pad at a given height.

20. The apparatus of claim 19, wherein the pedestal further comprises:

the range of angular orientations is about 90 degrees.

* * * * *